US009759017B2

(12) United States Patent
Benedict et al.

(10) Patent No.: US 9,759,017 B2
(45) Date of Patent: Sep. 12, 2017

(54) MAINTAINING TENSION OF A TRANSMISSION LINE IN A TUBULAR

(71) Applicants: Detlev Benedict, Celle (DE); Robert Buda, Lower Saxony (DE); Stephen Mueller, Hanover (DE); Volker Peters, Wienhausen (DE); Henning Rahn, Celle (DE); Rene Schulz, Lower Saxony (DE)

(72) Inventors: Detlev Benedict, Celle (DE); Robert Buda, Lower Saxony (DE); Stephen Mueller, Hanover (DE); Volker Peters, Wienhausen (DE); Henning Rahn, Celle (DE); Rene Schulz, Lower Saxony (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 985 days.

(21) Appl. No.: 13/754,539

(22) Filed: Jan. 30, 2013

(65) Prior Publication Data

US 2014/0209324 A1 Jul. 31, 2014

(51) Int. Cl.
*E21B 23/01* (2006.01)
*E21B 17/02* (2006.01)

(52) U.S. Cl.
CPC ..... *E21B 17/023* (2013.01)

(58) Field of Classification Search
CPC ..... E21B 23/01; H02G 15/18
USPC ..... 166/382
See application file for complete search history.

(56) References Cited

U.S. PATENT DOCUMENTS

| | | | | |
|---|---|---|---|---|
| 3,054,478 | A * | 9/1962 | Rumsey | F16F 7/09 188/129 |
| 4,971,147 | A | 11/1990 | Thomeer | |
| 5,435,395 | A | 7/1995 | Connell | |
| 6,830,467 | B2 | 12/2004 | Hall et al. | |
| 6,982,384 | B2 | 1/2006 | Hall et al. | |
| 7,299,867 | B2 | 11/2007 | Hall et al. | |
| 8,118,093 | B2 | 2/2012 | Hassell et al. | |
| 9,048,653 | B2 * | 6/2015 | D'Angelo, III | H02G 15/18 |

(Continued)

FOREIGN PATENT DOCUMENTS

KR 101223221 B1 1/2013

OTHER PUBLICATIONS

Hernandez, "The Evolution and Potential of networked Pipe", Technology Update, JPT, Apr. 2010. pp. 26-28.

(Continued)

*Primary Examiner* — Hoa C Nguyen
*Assistant Examiner* — Stanley Tso
(74) *Attorney, Agent, or Firm* — Cantor Colburn LLP

(57) ABSTRACT

An apparatus for maintaining tension of a transmission line in a tubular includes a first clamp segment configured to surround at least a portion of a transmission line and a second clamp segment configured to surround at least a portion of the transmission line. The second clamp segment has a first axial end and a second axial end. The first axial end is configured to contact an axial end of the first clamp segment, such that the first clamp segment and the second clamp segment are configured to apply a force in opposite radial directions to clamp the transmission line with respect to the tubular to lock a position of the transmission line with respect to the tubular.

19 Claims, 6 Drawing Sheets

(56) References Cited

U.S. PATENT DOCUMENTS

| | | | | |
|---|---|---|---|---|
| 2002/0005282 | A1 | 1/2002 | Holbert | |
| 2002/0135179 | A1 | 9/2002 | Boyle et al. | |
| 2004/0149471 | A1 | 8/2004 | Hall | |
| 2004/0150532 | A1* | 8/2004 | Hall | E21B 17/003 340/854.3 |
| 2004/0150533 | A1 | 8/2004 | Hall | |
| 2004/0244964 | A1 | 12/2004 | Hall | |
| 2005/0001736 | A1 | 1/2005 | Hall | |
| 2005/0045339 | A1 | 3/2005 | Hall | |
| 2005/0143765 | A1* | 6/2005 | Bachmann | A61F 5/0053 606/157 |
| 2005/0145406 | A1 | 7/2005 | Hall et al. | |
| 2006/0158296 | A1 | 7/2006 | Hall et al. | |
| 2008/0106433 | A1 | 5/2008 | Madhavan et al. | |
| 2009/0126162 | A1 | 5/2009 | Head et al. | |
| 2010/0111592 | A1* | 5/2010 | Hassell | E21B 17/023 403/24 |
| 2010/0230802 | A1 | 9/2010 | Benjavasukul et al. | |
| 2010/0307748 | A1 | 12/2010 | Casciaro et al. | |
| 2015/0300114 | A1* | 10/2015 | Pelto | E21B 23/01 166/377 |

OTHER PUBLICATIONS

Notification of Transmittal of the International Search Report and the Written Opinion of the International Searching Authority, or the Declaration; PCT/US2014/013556; May 19, 2014, 15 pages.

Dieter Muhs et al.: "Roloff/Matek Maschinenelennente"; Vieweg publisher, 1963, German 17th edition (2005); pp. 368-373.

Notification of Transmittal of the International Search Report and the Written Opinion of the International Searching Authority, or the Declaration; PCT/US2014/013564; May 9, 2014, 16 pages.

* cited by examiner

MAINTAINING TENSION OF A TRANSMISSION LINE IN A TUBULAR

BACKGROUND

The present invention relates to maintaining the tension in a transmission line in a tubular, and in particular to an apparatus, an assembly and a method for clamping a transmission line in a tubular to maintain tension on the transmission line.

Wires, antenna and other electrical lines and devices may extend along tubulars in boreholes to gather and transmit information to devices inside the borehole and devices outside the borehole. Since the tubulars are subject to various physical forces including vibration, rotation, and linear motion, electrical lines extending through the tubulars are also subject to demanding physical phenomena. Loose antenna, wires and other electrical lines may be subject to additional stresses, resulting in physical damage to the electrical lines, disconnection or other potential problems.

SUMMARY

Embodiments of the invention relate to an apparatus for locking a transmission line in a tubular including a first clamp segment configured to surround at least a portion of a transmission line and a second clamp segment configured to surround at least a portion of the transmission line. The second clamp segment has a first axial end and a second axial end. The first axial end is configured to contact an axial end of the first clamp segment, such that the first clamp segment and the second clamp segment are configured to apply a force in opposite radial directions to clamp the transmission line with respect to the tubular to lock a position of the transmission line with respect to the tubular.

Embodiments of the invention also relate to an assembly for maintaining tension on a transmission line including a tubular, a transmission line extending through the tubular and a clamp device. The clamp device includes a first clamp segment configured to surround at least a portion of the transmission line and a second clamp segment configured to surround at least a portion of the transmission line and having a slanted surface contacting a slanted surface of the first clamp segment. The first clamp segment and the second clamp segment are configured to apply a force in opposite radial directions to clamp the transmission line with respect to the tubular to lock a position of the transmission line with respect to the tubular.

Embodiments of the invention also include a method for maintaining tension of a transmission line. The method includes applying tension to a transmission line in a tubular to draw taut the transmission line into a tensioned state and fixing the transmission line in the tensioned state by applying an axial force to a clamp device, where the clamp device fixes the transmission line with respect to the tubular.

BRIEF DESCRIPTION OF THE DRAWINGS

Referring now to the drawings wherein like elements are numbered alike in the several Figures.

DETAILED DESCRIPTION

Embodiments of the present invention relate to maintaining the tension of a transmission line in a tubular of a borehole.

Figure 1:
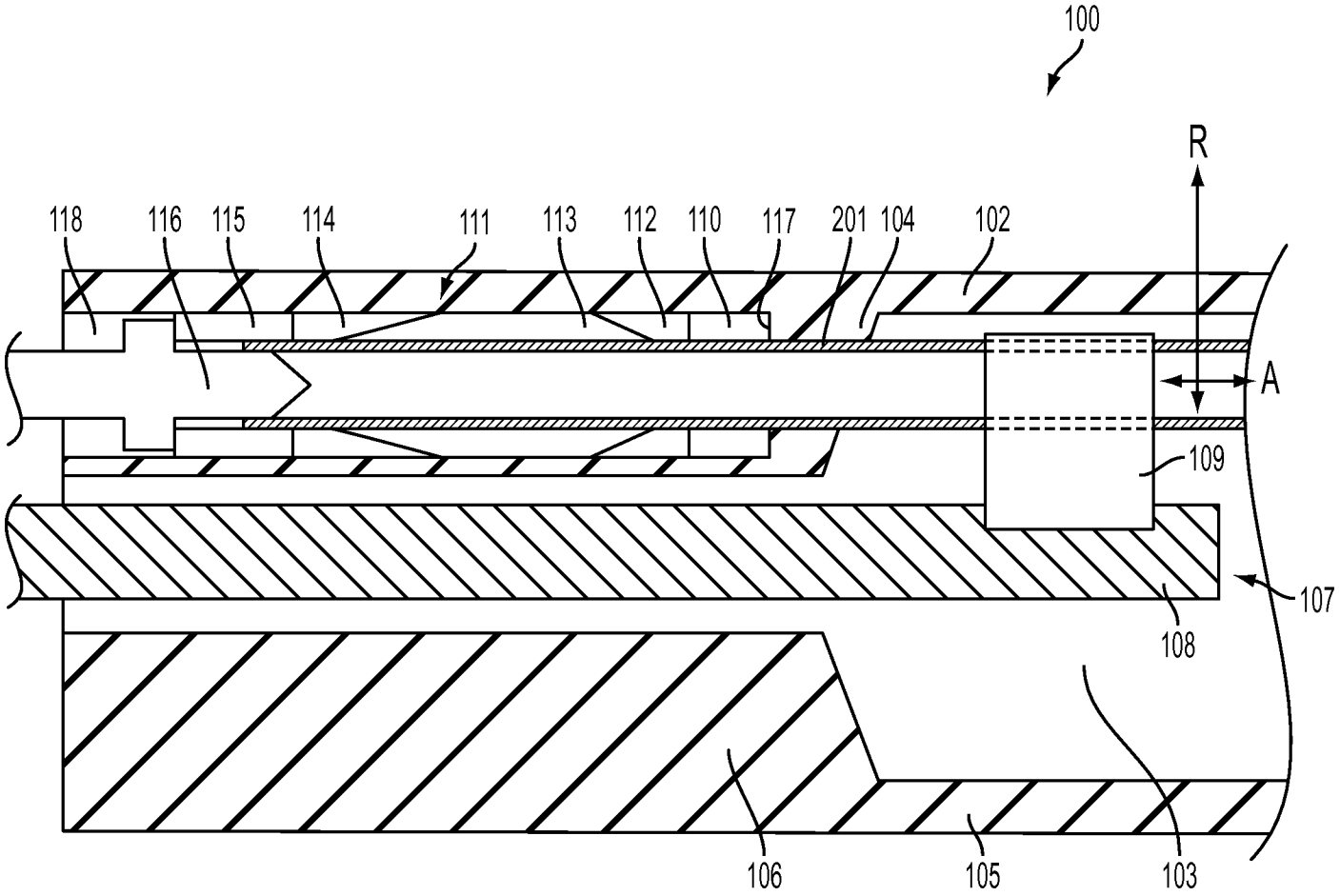
FIG. 1 illustrates a clamping apparatus according to one embodiment of the invention.
Figure 2:
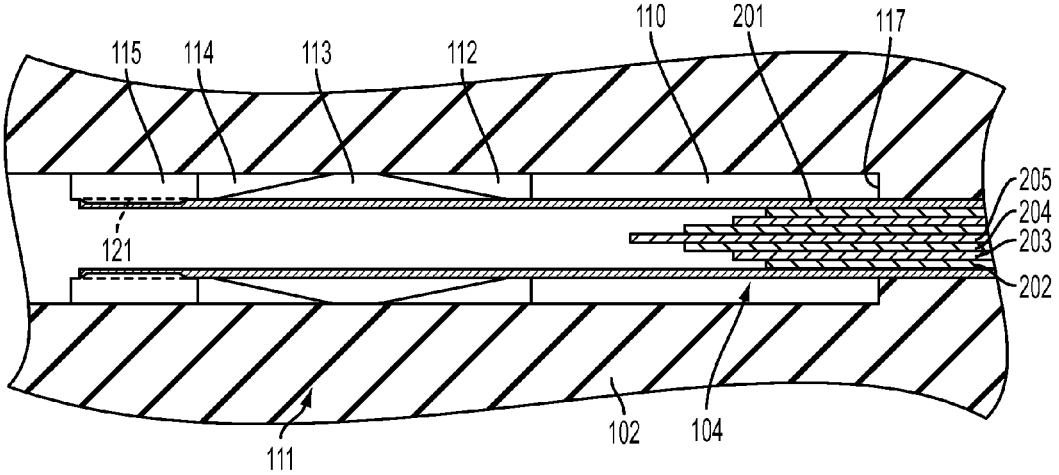
FIG. 2 illustrates a clamping assembly according to one embodiment of the invention.

Referring to FIGS. 1 and 2, a transmission line clamp assembly 100 includes a tubular 102, a transmission line 104 extending through the tubular 102, a clamping device 111 and an inner-pipe clamp 107. The clamping device 111 fixes a position of the transmission line 104 with respect to the tubular 102.

The tubular 102 may include any type of tubular, such as a drill pipe used for drilling a well or a completion pipe used for extracting fluids from the well. The tubular 102 may include a narrow-opening portion 106 at its end and a wide-opening portion 105 towards its center, defining a channel 103 through which fluids flow, such as drilling fluids or earth formation fluids. The line clamp assembly 100 may be made up of one single tubular 102 or of multiple tubulars or multiple tubular segments.

The transmission line 104 may be any type of wire, cable or conduit. As illustrated in FIG. 2, the transmission line 104 includes a wire channel 201, which may be a tube, such as a metal tube, cladding layers 202, 203 and 204 and a transmission wire 205. The cladding layers 202 to 204 include any combination of insulating layers, grounding layers and transmission layers. The transmission line 104 may include any type of communications line or wire including coaxial, twisted wire pairs and single wire. Embodiments of the invention are not limited to the specific transmission line 104 structure illustrated in FIGS. 1 and 2. The wire channel 201 is illustrated in FIG. 1 for purposes of description. However, it is understood that the cladding layers 202 to 204 and transmission wire 205 may extend any length along the wire channel 104.

The tubular 102 also includes a transmission line channel 118 in the body of the tubular 102 through which the transmission line 104 extends. The transmission line channel 118 includes a shoulder 117 separating a wide portion of the channel from a narrow portion. The clamp device 111 includes a sleeve 110, which may also be referred to as a spacer 110. The clamp device 111 includes a first clamp segment 112, second clamp segment 113, third clamp segment 114 and a fixing mechanism 115, also referred to in the present specification as a nut 115.

As the nut 115 is screwed onto the wire channel 201 by the tightening device 116, which may be a screwdriver or other type of bit adapted to fit the nut 115, the nut 115 applies a force having an axial element to an end of the third clamp segment 114. The third clamp segment 114 exerts a force against the second clamp segment 113. Since the second and third clamp segments 113 and 114 contact each other along slanted surfaces, the third clamp segment 114 exerts a force having both an axial component and a radial component. In FIG. 1, an axial direction A corresponds to a direction along a length axis of the transmission line 104, while a radial direction R corresponds to a direction perpendicular to the axial direction A extending radially from a center of the transmission line 104. The radial component of the force from the third clamp segment 114 pushes the second clamp segment 113 in a radially-inward direction toward the transmission line 104, clamping the transmission line 104.

The second clamp segment 113 exerts the axial component force against the first clamp segment 112. Since the second and first clamp segments 113 and 112 contact each other along slanted surfaces, the second clamp segment 113 exerts a force having both an axial component and a radial component. The radial component pushes the first clamp segment 112 in a radially-outward direction toward an inner surface of the transmission line channel 118, clamping the transmission line 104 with respect to the transmission line channel 118.

The axial component of the force exerted against the first clamp segment 112 is exerted against the sleeve 110, and is in turn exerted against the shoulder 117. Since the shoulder is stationary, a force equal to the force exerted against the shoulder is exerted against the sleeve 110. At least a portion of the force exerted against the sleeve 110 is transferred to the first clamp segment 112, the second clamp segment 113, the third clamp segment 114 and the nut 115. The radial component of the force exerted by the first clamp segment 112 against the second clamp segment 113 pushes the second clamp segment 113 inward to clamp the transmission line 104. The radial component of the force exerted by the second clamp segment 113 against the third clamp segment 114 pushes the third clamp segment 114 outward to press against an inside diameter of the channel to clamp the transmission line 104 with respect to the channel 118.

The threads 121 of the nut 115 engage the nut 115 with respect to the wire channel 201 to maintain a position of the nut 115 with respect to the wire channel 201. Accordingly, the clamping function of the clamp device 111 is maintained constant by the nut 115.

In one embodiment, the first, second and third clamp segments 112, 113 and 114 are cylindrically-shaped devices. In one embodiment, the cylinders include a slit that cuts through the cylinder in a radial direction and extends lengthwise along an axial length of the cylinders. In one embodiment, the first and third clamp segments 112 and 114 are cylinders having one flat end configured to face outward from the clamp device 111 and one tapered end configured to face inward toward a center of the clamp device 111. The tapered ends may be tapered to decrease in thickness from the outward facing end to an inward-most end or point. In contrast, the second clamp segment 113 may have tapered ends at each axial end of the second clamp segment 113, the tapered ends increasing in thickness from the ends of the cylinder toward the center of the cylinder (see, for example, FIGS. 1 and 2).

Referring to FIG. 1, the inner-pipe clamp 107 includes an extension portion 108 and a clamp portion 109. In embodiments of the present invention, the inner-pipe clamp 107 is inserted into the tubular 102 and clamped to a portion of the transmission line 104 farther into the tubular 102 relative to the clamp device 111. An axial pulling force may be applied to the inner-pipe clamp 107 to pull the transmission line 104 taut, or to establish a predetermined level of tension in the transmission line 104. In operation, the inner-pipe clamp 107 may be inserted into the tubular 102 to temporarily provide a predetermined level of tension in the transmission line 104 until the clamp device 111 is clamped to establish a permanent level of tension in the transmission line 104. Then, the inner-pipe clamp 107 may be removed from the tubular 102 and the tightening tool 116 may also be removed. Accordingly, the transmission line 104 may be maintained at a predetermined level of tension.

Figure 4:
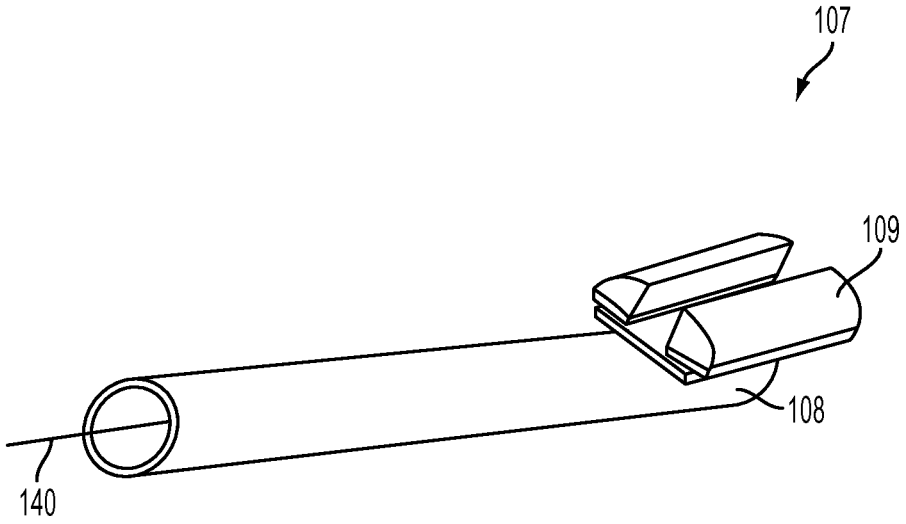
FIG. 4 illustrates an inner-pipe clamp according to one embodiment of the invention.

Referring to FIG. 4, the inner-pipe clamp 107 may be actuated by any actuation mechanism, such as an actuation line 140, including a wire, cable or rod. In addition, the clamp 109 or any other structure of the inner-pipe clamp 107 may include, one or more springs or bias mechanisms, or any other actuator capable of causing the clamp 109 to close on, and grip, the transmission line 104 and capable of reopening the clamp 109 to allow the inner-pipe clamp 107 to be removed from the tubular 102.

Figure 3:
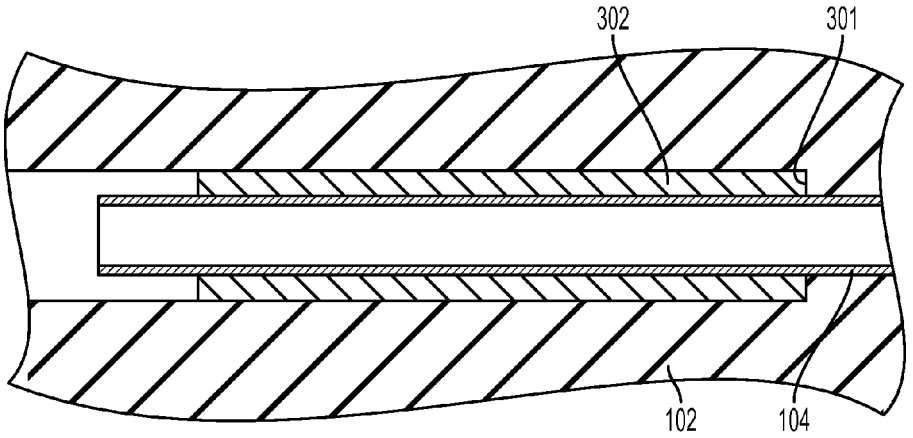
FIG. 3 illustrates a stopping device according to one embodiment of the invention.

FIGS. 1 and 2 illustrate a clamp device 111 at one end of a tubular 102. In embodiments of the invention, a second clamp device 111 may be located at an opposite end of the tubular 102, or a stopping device may be positioned at the opposite end of the tubular 102. FIG. 3 illustrates a stopping device 302 according to one embodiment. The stopping device 302, which may also be referred to as a shoulder ring 302, may be any metal or other sturdy, stiff, hard substance capable of maintaining a shape and grip on the transmission line 104 when a tension force is applied to the transmission line 104. An inner diameter of the stopping device 302 grips the transmission line 104. An end of the stopping device 302 abuts a shoulder 301 of the tubular 102 when the inner-pipe clamp 107 draws the transmission line 104 taut to have a predetermined tension level, and while the clamp device 111 maintains the transmission line 104 at the predetermined tension level. Unlike the clamp device 111, the stopping device 302 may not have a clamp strength that is adjustable once the stopping device 302 is inserted into the tubular 102. Instead, the stopping device 302 may have a predetermined clamp strength capable of maintaining a clamp on the transmission line 104 while the inner-pipe clamp 107 and clamp device 111 are adjusted to increase a tension in the transmission line 104. In one embodiment, the stopping device 302 is made from a material with superior anti-galling properties to prevent fretting and shoulder damage during handling at a rig site. In one embodiment, the stopping device 302 is permanently fixed to the transmission line by soldering, welding, gluing, press-fitting or other means.

While FIGS. 1 and 2 illustrate a clamp device 111 having multiple segments for generating radial force against a transmission line 104 and a surrounding channel 118, embodiments of the present invention are not limited to the clamp device 111 illustrated in these figures. Embodiments of the invention encompass any clamping mechanism capable of being adjusted while located inside a wire channel of a tubular from an initial un-clamped state to a clamp state in which the transmission line is fixed in position, and maintains a predetermined tension, with respect to the surrounding wire channel. For example, a clamp device according to embodiments of the invention may include only one segment capable of exerting a radial force in opposing directions, may include two segments, may include the three segments illustrated in FIGS. 1 and 2, or may include additional segments.

In addition, FIGS. 1 and 2 illustrate a nut 115 that engages the wire channel 201 by a threaded portion. However, any mechanism may be used to apply a constant force to the clamp device 111. For example, a cylinder having teeth may be used, a cylinder including latch mechanisms to engage pre-formed recesses in the wire channel 201 may be used, a constricting mechanism may be used, such as a mechanism that deforms based on being heated or having an axial force or torque applied, or any other type of fixing mechanism may be used that is capable of applying a force to the clamp device 111 and maintaining the force without receiving an externally-provided force, such as a force from a drill bit, screw head, or any other externally provided force.

In addition, in one embodiment, no nut 115 or other force-maintaining mechanism is used. For example, one or more of the clamp device, the wire channel 201 and the inside surface of the tubular 102 may have teeth, ridges or other engaging mechanisms, such that when a force is applied to the third clamp segment 114 to press against and engage the second clamp segment 113, the clamp device 111 is maintained in position, even when a force-applying apparatus is removed. While teeth or ridges are provided as an example of an engaging mechanism, embodiments of the invention encompass any engaging mechanism, such as an adhesive or solder.

Figure 5:
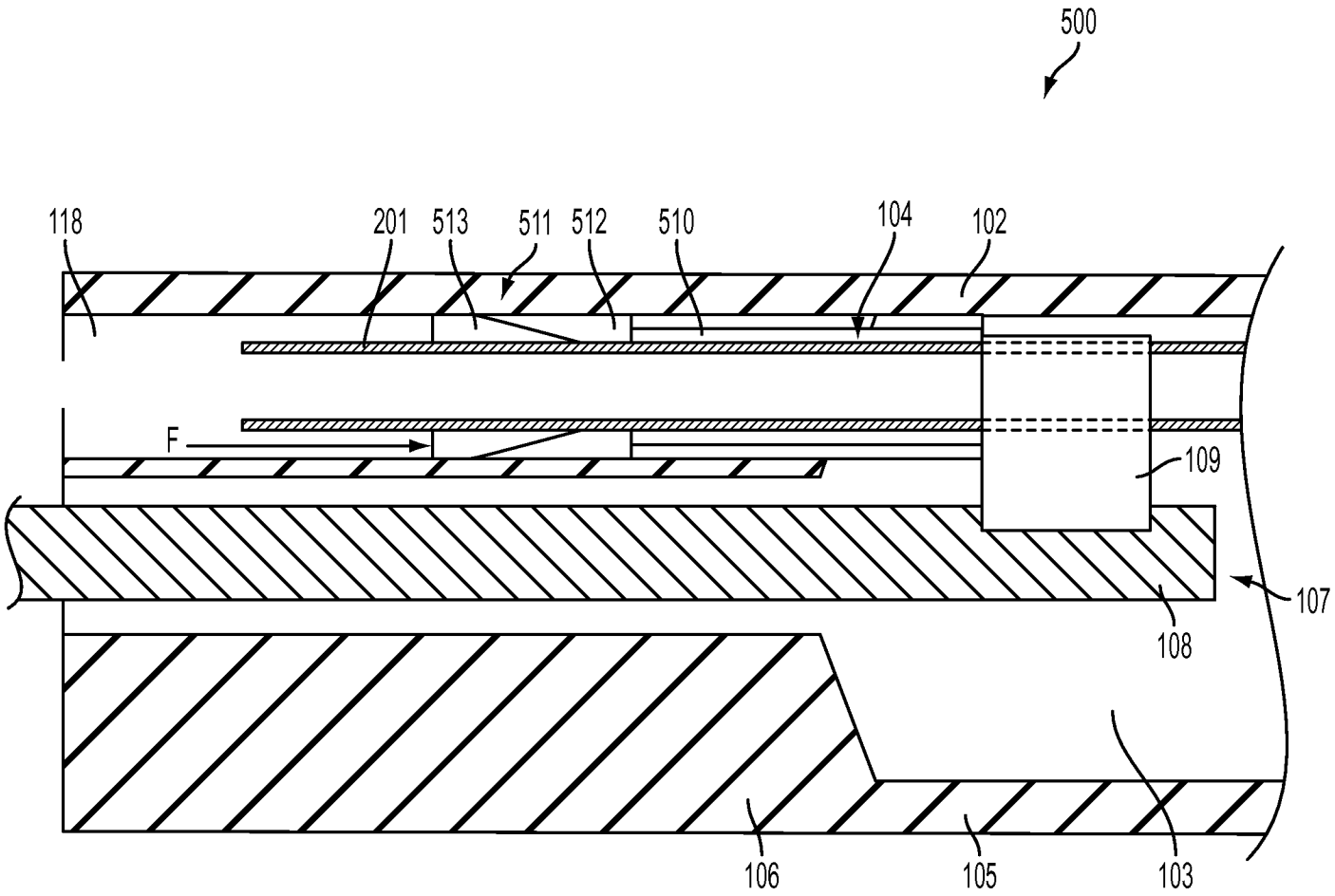
FIG. 5 illustrates a clamping apparatus according to another embodiment of the invention.

FIG. 5 illustrates a transmission line clamp assembly 500 in which no force-maintaining mechanism is used. The transmission line clamp assembly 500 includes the tubular 102, a transmission line 104 extending through the tubular 102, a clamping device 511 and an inner-pipe clamp 107. The clamping device 511 fixes a position of the transmission line 104 with respect to the tubular 102.

The tubular 102 may include any type of tubular, such as a drill pipe used for drilling a well or a completion pipe used for extracting fluids from the well. The tubular 102 may include a narrow-opening portion 106 at its end and a wide-opening portion 105 towards its center, defining a channel 103 through which fluids flow, such as drilling fluids or earth formation fluids. The line clamp assembly 500 may be made up of one single tubular 102 or of multiple tubulars or multiple tubular segments.

The transmission line 104 may be any type of wire, cable or conduit. The transmission line 104 includes a wire channel 201, which may be a tube, such as a metal tube. The tubular 102 also includes a transmission line channel 118 in the body of the tubular 102 through which the transmission line 104 extends. The clamp device 511 includes a sleeve 510, which may also be referred to as a spacer 510. The clamp device 511 includes a first clamp segment 512 and a second clamp segment 513.

As illustrated in FIG. 5, the spacer 510 extends from the clamp 109 to the first clamp segment 512 to maintain a location of the first clamp segment 512 relative to the clamp 109. A force F is exerted against the second clamp segment 513, pushing the first clamp segment 512 radially outward and the second clamp segment 513 radially inward. In one embodiment, one or both of the first clamp segment 512 and the second clamp segment 513 includes ridges, teeth or grooves to engage ridges, teeth or grooves of the other of the first and second clamp segments 512 and 513. Consequently, when the force F is removed, the first and second clamp segments 512 and 513 stay in position.

In another embodiment, the inclination angle of the slanted surfaces of the first clamp segment 512 and the second clamp segment 513 are configured to prevent slippage between the first clamp segment 512 and the second clamp segment 513. For example, the inclination angle of the slanted surfaces of the first clamp segment 512 and the second clamp segment 513 may be less than an arctangent of the coefficients of friction (also referred to as the friction angle) of the first clamp segment 512 and the second clamp segment 513, respectively.

In addition one or both of the wire channel 201 and the inside surface of the tubular 102, as well as the clamp segment 512 or 513, may have smooth surfaces if the inclination angle of the slanted surfaces of the first clamp segment 512 and the second clamp segment 513 are below the friction angle. With the inclination angles being smaller than the friction angle, the mechanism will be self-locking even if the installation or setting force is removed. Accordingly, in such an embodiment, no shoulder 117 and no nut 115 are required.

In one embodiment, the spacer 510 is a partial cylinder, such as a half-cylinder or cylinder having a 180 degree to 200 degree arc. The spacer 510 is set on the wire channel 201 during fixing of the clamp device 511 and the spacer 510 is removed after locking the clamp device 511 into place. In such an embodiment, during normal operation, only the clamp device 511 is left in the tubular 102 to fix the transmission line 104 with respect to the tubular 102. Each of a force F generating device, the sleeve 510 and the inner-pipe clamp 107 is removed.

Figure 6:
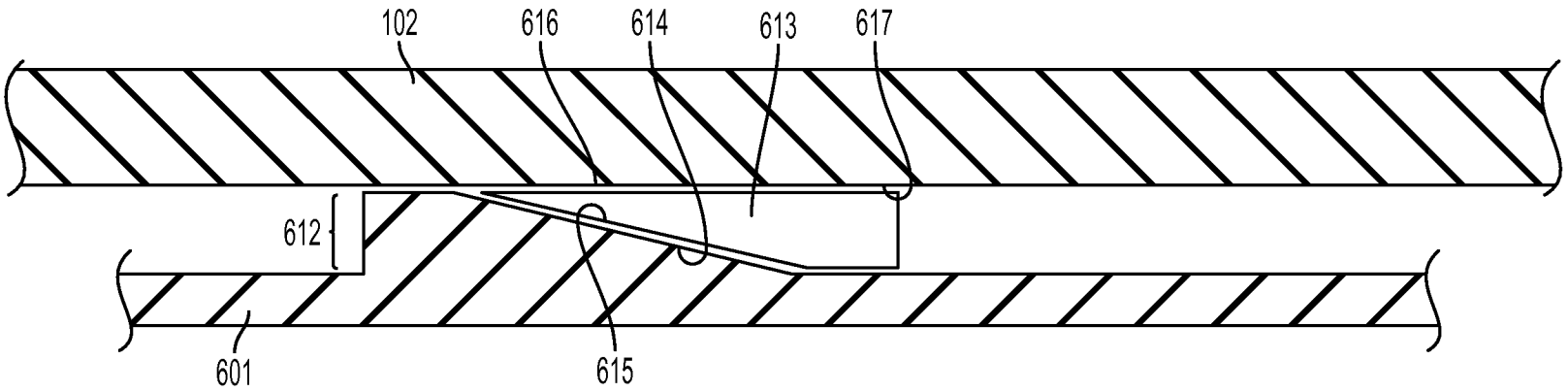
FIG. 6 illustrates a portion of a wire channel according to an embodiment of the invention.

FIG. 6 illustrates a portion of a wire channel 601 according to another embodiment of the invention. The wire channel 601 includes locking mechanism 612 that is integral with the wire channel 601. The locking mechanism 612 is illustrated as a ramp in FIG. 6, but the locking mechanism 612 may be any structure configured to interact with a clamp segment 613 to lock the wire channel 601 with respect to the tubular 102.

The locking mechanism 612 includes an inclined surface 615 configured to engage an inclined surface 614 of the clamp segment 613. When a force is exerted against the clamp segment 613 in an axial direction of the tubular 102 toward the locking mechanism 612, the clamp segment 613 is pressed radially outward toward the inner wall 617 of the tubular 102. In one embodiment, one or more of the inclined surface 615 of the locking mechanism 612, the inclined surface 614 of the clamp segment 613, the radially-outward-facing surface 616 of the clamp segment 613 and the radially-inward-facing surface 617 of the tubular 102 includes one or more of ridges, grooves, teeth or an adhesive to fix the clamp segment 613 into position between the locking mechanism 612 and the tubular 102.

Figure 7:
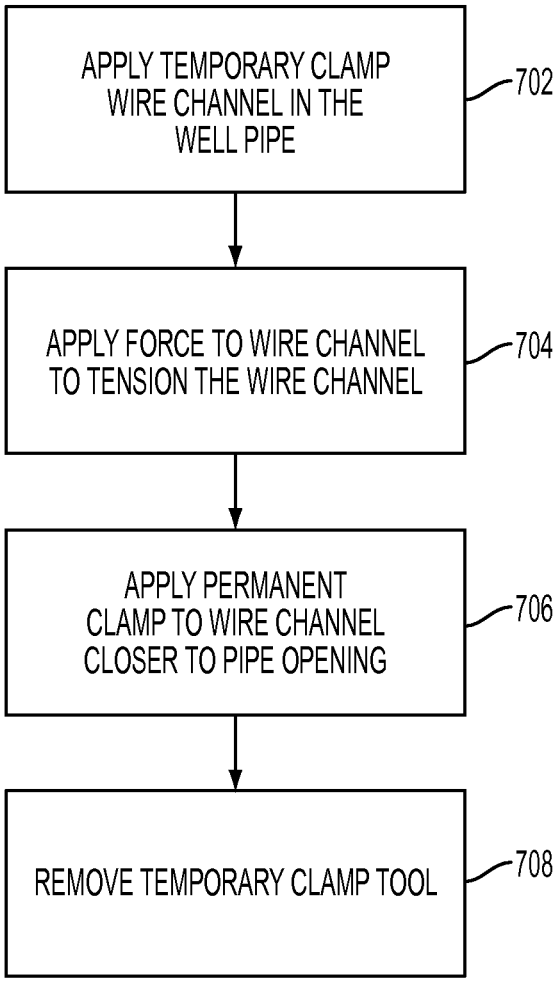
FIG. 7 illustrates a flowchart of a method for maintaining tension of a transmission line according to one embodiment of the invention.

FIG. 7 illustrates a flowchart of a method for applying tension in a transmission line according to an embodiment of the invention. In block 702, a temporary clamp is applied to a transmission line inside a tubular. The temporary clamp may be capable of closing to grip the transmission line and opening to release the transmission line.

In block 704, a force is applied to the temporary clamp to establish a predetermined tension in the transmission line. For example, one end of the transmission line may be fixed and the temporary clamp may be affixed to the opposite end. A user, machine, device or system may pull the temporary clamp to exert a predetermined level of force or stroke on the transmission line and to establish a predetermined tension level in the transmission line.

In block 706, a permanent clamp is applied to the transmission line. The permanent clamp may be located closer to an opening of the tubular than the temporary clamp. In one embodiment, the permanent clamp includes one or more clamp segments configured to surround at least a portion of the transmission line and to exert a force on the transmission line and on an inside diameter of a surrounding channel to fix the transmission line in place with respect to the surrounding channel.

In one embodiment, the permanent clamp is fixed by mating a thread of a nut with a thread of an outer diameter of the transmission line. Alternatively, the thread of the nut may dig into an un-threaded portion of the transmission line. Alternatively, the permanent clamp may be affixed by any other clamping or fixing mechanism, such as by latches, teeth, etc. In another embodiment, no fixing mechanism is used, and the permanent clamp maintains its position relative to the transmission line and the surrounding channel by one or more of friction, an adhesive and solder.

In block 708, the temporary clamp tool is removed from the transmission line once the permanent clamp has been fixed to the transmission line and the channel surrounding the transmission line. Accordingly, the tension level of the transmission line is maintained by the permanent clamp.

According to embodiments of the invention, a clamping mechanism is provided that maintains a tension of a transmission line with respect to a tubular. The clamping mechanism may also prevent rotation of the transmission line. In addition, the clamping mechanism is adjustable after being inserted into the tubular to increase or decrease a clamp strength, and the clamping mechanism is insertable and removable from the tubular. Embodiments of the invention also include a temporary clamping mechanism configured to apply a predetermined level of tension to the transmission line while a permanent clamp mechanism is affixed to the transmission line. By fixing the tension of the transmission line and preventing rotation of the transmission line, the transmission line is able to withstand environmental stressed, including vibration and rotation of the tubular in a borehole.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. An apparatus for locking a transmission line in a tubular, the apparatus comprising:

a first clamp segment configured to be disposed at an interior of the tubular and surround at least a portion of a wire channel of a transmission line, the wire channel housing a communications line therein;

a second clamp segment configured to be disposed at the interior of the tubular and surround at least a portion of the wire channel of the transmission line, the second clamp segment having a first axial end and a second axial end, the first axial end configured to contact an axial end of the first clamp segment, such that the first clamp segment and the second clamp segment are configured to apply radial forces in opposite radial directions to clamp the wire channel with respect to the tubular to lock a position of the wire channel with respect to the tubular and maintain tension in the wire channel within the tubular, one of the radial forces being an outward radial force that pushes the first clamp segment against an inner surface of the tubular, and another of the radial forces being an inward radial force that pushes the second clamp segment against a surface of the wire channel, the radial forces operating together and being sufficient to maintain the wire channel in a fixed position relative to the tubular and maintain tension in the wire channel; and a fixing mechanism configured to be fixed relative to an outside surface of the wire channel and to apply a force against the second axial end of the second clamp segment, wherein the radial forces are sufficient to maintain both the position and the tension via friction, upon removal of the fixing mechanism, independent of any other fixing mechanism.

2. The apparatus of claim 1, wherein the axial end of the first clamp segment has a first slanted surface, the first axial end of the second clamp segment has a second slanted surface, and the second slanted surface is configured to exert a force against the first slanted surface with both an axial vector and a radial vector based on the axial force being applied to the first axial end of the second clamp segment.

3. The apparatus of claim 2, wherein the inclination angles of the first slanted surface and the second slanted surface are less than an arctangent of the coefficient of friction of the first clamp segment and the second clamp segment, respectively.

4. The apparatus of claim 1, wherein the first clamp segment includes a first axial end and a second axial end, the first axial end configured to contact the second clamp segment, the apparatus further comprising:

a third clamp segment configured to surround at least a portion of the wire channel on an opposite side of the first clamp segment from the second clamp segment, the third clamp segment configured to contact the second axial end of the first clamp segment, such that the first clamp segment and the third clamp segment are configured to apply a force in opposite radial directions to clamp the wire channel with respect to the tubular based on a force being applied to the third clamp segment.

5. The apparatus of claim 4, wherein the third clamp segment includes a first axial end with a first slanted surface and a second axial end opposite the first axial end, the second axial end of the second clamp segment has a second slanted surface, and the first slanted surface of the third clamp segment is configured to exert a force against the second slanted surface of the second clamp segment with both an axial vector and a radial vector based on the axial force being applied to the second axial end of the third clamp segment.

6. The apparatus of claim 1, wherein the first clamp segment, the second clamp segment and the wire channel are configured to be disposed within and extend through a transmission line channel formed in a body of the tubular.

7. The apparatus of claim 1, wherein the second clamp segment maintains the position via a frictional connection between the second clamp segment and the inner surface of the tubular.

8. The apparatus of claim 1, wherein each of the inner surface of the tubular and the surface of the wire channel are smooth surfaces, and the radial forces are configured to maintain the wire channel in the fixed position and maintain the tension in the wire channel via friction without any other fixing mechanism.

9. The assembly of claim 1, wherein the wire channel is a tube configured to house the communication line therein.

10. The apparatus of claim 1, further comprising an additional fixing mechanism.

11. The apparatus of claim 10, wherein the additional fixing mechanism is configured to apply a force against at least one of the first clamp segment and the second clamp segment.

12. An assembly for maintaining tension in a transmission line, comprising:

a tubular;

a wire channel of a transmission line extending through the tubular, the wire channel housing a communications line therein;

a clamp device including a first clamp segment configured to be disposed at an interior of the tubular and surround at least a portion of the wire channel of the transmission line, and a second clamp segment configured to be disposed at an interior of the tubular and surround at least a portion of the wire channel and having a slanted surface contacting a slanted surface of the first clamp segment, the first clamp segment and the second clamp segment configured to apply radial forces in opposite radial directions to clamp the wire channel with respect to the tubular to lock a position of the wire channel with respect to the tubular and maintain tension in the wire channel within the tubular, one of the radial forces being an outward radial force that pushes the first clamp segment against an inner surface of the tubular, and another of the radial forces being an inward radial force that pushes the second clamp segment against a surface of the wire channel, the radial forces operating together to maintain the wire channel in a fixed position relative to the tubular and maintain tension in the wire channel; and a fixing mechanism configured to be fixed relative to an outside surface of the wire channel and to apply a force against the second axial end of the second clamp segment, wherein the radial forces are sufficient to maintain both the position and the tension via friction, upon removal of the fixing mechanism, independent of any other fixing mechanism.

13. The assembly of claim 12, wherein the slanted surface of the second clamp segment is configured to exert a force with both an axial vector and a radial vector against the slanted surface of the first clamp segment based on the axial force being applied to the axial end of the second clamp segment.

14. The assembly of claim 12, wherein the tubular includes a channel through which the wire channel extends, the channel including a shoulder, the first clamp segment includes a first axial end contacting the second clamp segment and a second axial end configured to apply a force to the shoulder of the channel, such that the shoulder of the channel maintains the first clamp segment stationary with respect to the tubular.

15. The assembly of claim 14, further comprising:

a sleeve located between the shoulder and the first clamp segment, wherein the first clamp segment applies the force to the shoulder via the sleeve.

16. The assembly of claim 8, further comprising:

an inner-pipe clamp device configured to be inserted into the tubular at a location further into the tubular than the clamp device, the inner-pipe clamp device configured to clamp the wire channel, to pull the wire channel taut into a tensioned state, and to be disengaged from the wire channel and removed from the tubular based on the wire channel being fixed by the clamp device in the tensioned state.

17. The assembly of claim 16, further comprising:

a sleeve located between the inner-pipe clamp and the first clamp segment, wherein the first clamp segment applies the force to the inner-pipe clamp via the sleeve.

18. The assembly of claim 12, further comprising an additional fixing mechanism.

19. The assembly of claim 18, wherein the additional fixing mechanism is configured to apply a force against the clamp device.

* * * * *